US011780250B2

(12) United States Patent
Tanabe

(10) Patent No.: US 11,780,250 B2
(45) Date of Patent: Oct. 10, 2023

(54) PRINTING APPARATUS

(71) Applicant: FUJITSU FRONTECH LIMITED, Tokyo (JP)

(72) Inventor: Hiromu Tanabe, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 7 days.

(21) Appl. No.: 17/649,441

(22) Filed: Jan. 31, 2022

(65) Prior Publication Data

US 2022/0153041 A1 May 19, 2022

Related U.S. Application Data

(63) Continuation of application No. PCT/JP2019/038148, filed on Sep. 27, 2019.

(51) Int. Cl.
*B41J 11/66* (2006.01)
*B41J 11/70* (2006.01)

(52) U.S. Cl.
CPC ..... *B41J 11/663* (2013.01); *B41J 11/70* (2013.01)

(58) Field of Classification Search
CPC . B41J 11/66; B41J 11/663; B41J 11/70; B41J 11/04; B41J 13/0036
See application file for complete search history.

(56) References Cited

U.S. PATENT DOCUMENTS

2018/0043703 A1 2/2018 Watanabe
2018/0170076 A1 6/2018 Wakamatsu

FOREIGN PATENT DOCUMENTS

JP 03224764 A 10/1991
JP 2001278515 A 10/2001
JP 2017024221 A * 2/2017
JP 2017024221 A 2/2017
JP 2017056583 A 3/2017
JP 6447661 B2 1/2019
JP 6525784 B2 6/2019

OTHER PUBLICATIONS

Komai, MachineTranslationofJP-2017024221-A, 2017 (Year: 2017).*
Written Opinion of the International Searching Authority of /JP2019/038148 dated Dec. 17, 2019.
Int'l. Search Report issued in PCT/JP2019/038148, dated Dec. 17, 2019.
Office Action issued in Japanese patent application No. 2021-548116, dated Jul. 5, 2022.

* cited by examiner

*Primary Examiner* — Scott A Richmond
(74) *Attorney, Agent, or Firm* — Greer Burns & Crain Ltd.

(57) ABSTRACT

A printing apparatus includes a platen roller that transports a medium, a print head that is disposed to face the platen roller and prints on the medium, a cutter that cuts off, from the medium, a printed portion on which printing has been performed by the print head, a drive that drives the platen roller, and a processor that controls the drive. After the printed portion is cut off by the cutter, the processor controls the drive such that the platen roller transports the medium in an ejection direction and holds the medium still. After an instruction to start next printing by the print head is received, the processor controls the drive such that the platen roller transports the medium in a reverse direction opposite to the ejection direction.

1 Claim, 9 Drawing Sheets

PRINTING APPARATUS

CROSS-REFERENCE TO RELATED APPLICATION

This application is continuation application of International Application PCT/JP2019/038148 filed on Sep. 27, 2019 and designated the U.S., the entire contents of which are incorporated herein by reference.

FIELD OF THE INVENTION

The embodiments described herein are related to a printing apparatus that prints on a medium.

BACKGROUND OF THE INVENTION

A printing apparatus such as an airline printer has conventionally been such that: a printed portion on which printing has been performed is cut off from a medium by a cutter; and then the medium is transported in a reverse direction opposite to an ejection direction, such that the leading end portion of the medium arrives at a platen roller facing a print head, thereby allowing the next printing to be performed starting from the leading end portion of the medium.

In the meant time, glue for laminating labels such as linerless labels or film labels on each other is used for luggage tags used by an airline printer. Especially, when the leading end portion of a medium, such as one for forming luggage tags, which includes an adhesive layer on a surface or inside thereof is held on the platen roller for a long time, the leading end portion will be pasted on the platen roller, and the medium will be entangled with the platen roller after a printing operation starts.

Proposed printing apparatuses include ones that hold a medium still with no positional shift after the medium is cut (see, for example, Japanese Patent No. 6525784), and ones that transport a medium after cutting in a reverse direction opposite to an ejection direction to a position where the leading end portion of the medium is not pasted on a platen roller (see, for example, Japanese Laid-open Patent Publication No. 2001-278515, Japanese Patent No. 6447661, and Japanese Laid-open Patent Publication No. 2017-56583).

BRIEF SUMMARY OF THE INVENTION

A disclosed printing apparatus includes a platen roller that transports a medium, a print head that is disposed to face the platen roller and prints on the medium, a cutter that cuts off, from the medium, a printed portion on which printing has been performed by the print head, a drive that drives the platen roller, and a processor that controls the drive. After the printed portion is cut off by the cutter, the processor controls the drive such that the platen roller transports the medium in an ejection direction and holds the medium still. After an instruction to start next printing by the print head is received, the processor controls the drive such that the platen roller transports the medium in a reverse direction opposite to the ejection direction.

The object and advantages of the present invention will be realized by the elements set forth in the claims or combinations thereof.

DETAILED DESCRIPTION OF THE INVENTION

Figure 1:
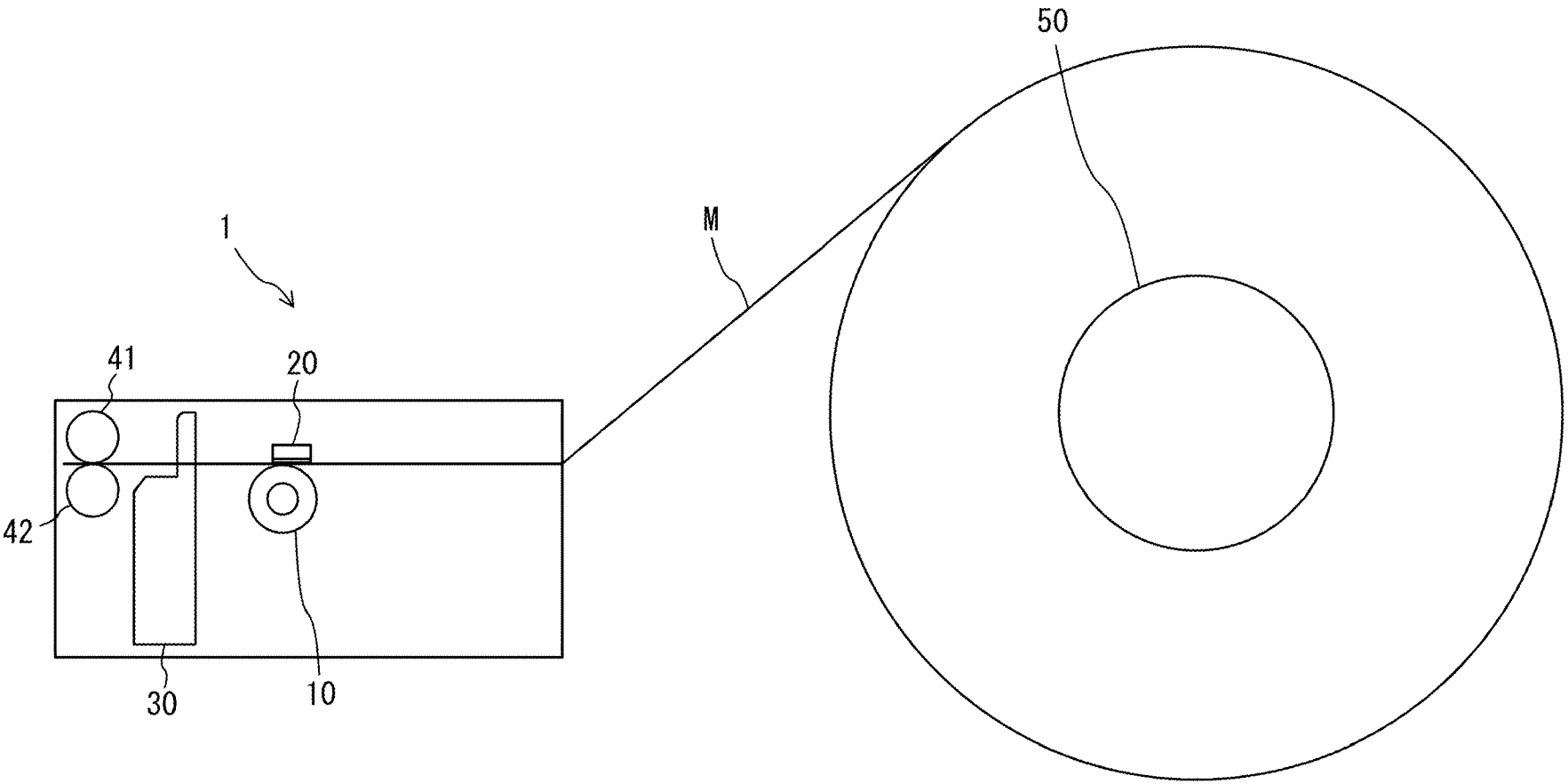
FIG. 1 is a side view illustrating the internal structure of a printing apparatus in accordance with an embodiment.

When starting printing based on a print instruction, it takes time to obtain print data, so it will be actually difficult to start printing as soon as the print instruction is received. Thus, there may be no temporal advantage in the leading end portion of a medium being positioned between a platen roller and a print head at a timing at which a print instruction is received.

Especially in a printing apparatus that includes an ejection roller and platen roller rotated by being driven by the same drive source, when a medium is, as described above, held still with no positional shift after being cut, a printed portion that has been cut off will also remain still with no positional shift after the cutting, so the medium cannot be ejected. In the case of a printing apparatus without an ejection roller, in comparison to when a printed portion that has been cut off remains still with no positional shift after cutting, a printed portion will be sent out for ejection when the remaining portion of the medium is transported in an ejection direction.

The following describes a printing apparatus in accordance with an embodiment of the present invention by referring to the drawings.

FIG. 1 is a side view illustrating the internal structure of a printing apparatus 1.

Figure 2:
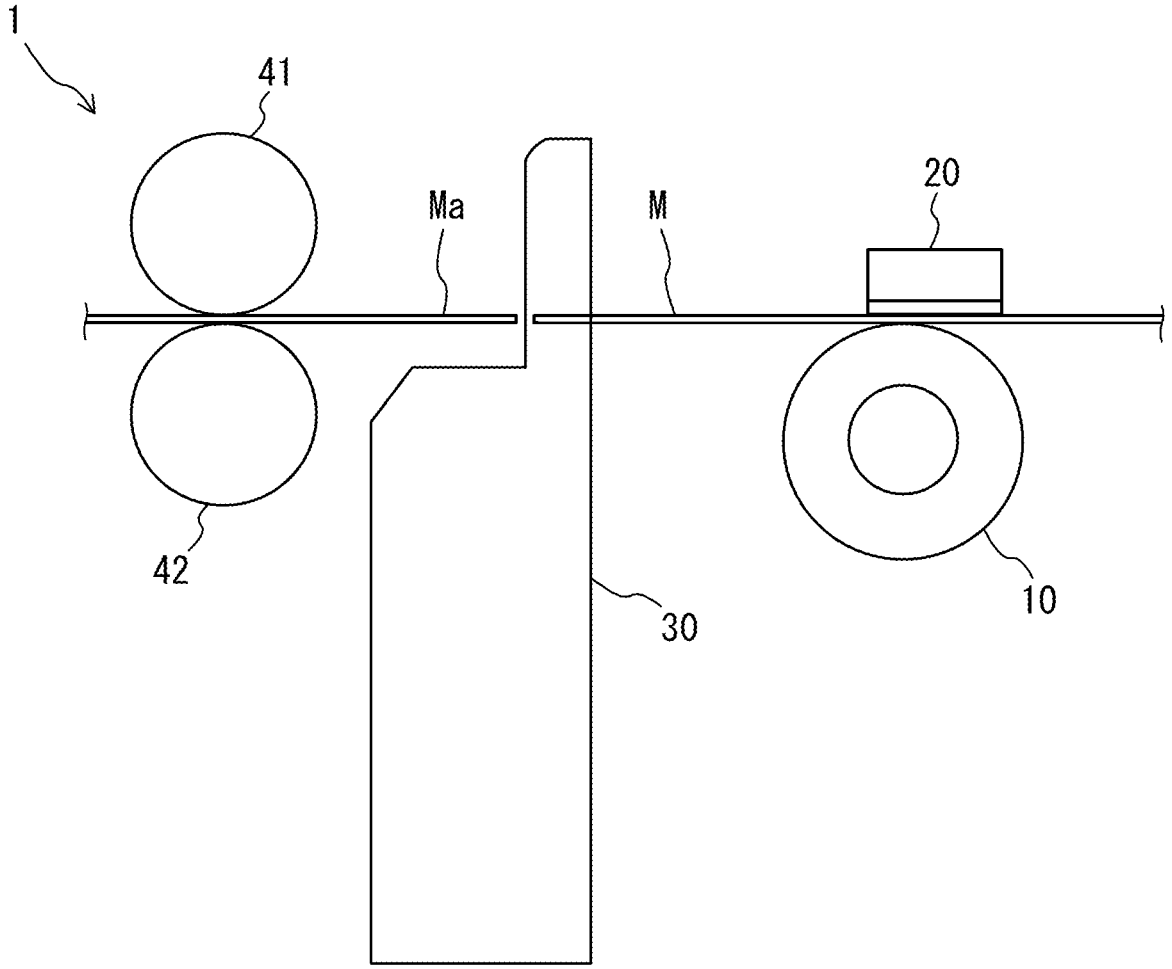
FIG. 2 is a side view illustrating the internal structure of portions of a printing apparatus in accordance with an embodiment.

FIG. 2 is a side view illustrating the internal structure of portions of the printing apparatus 1.

Figure 3:
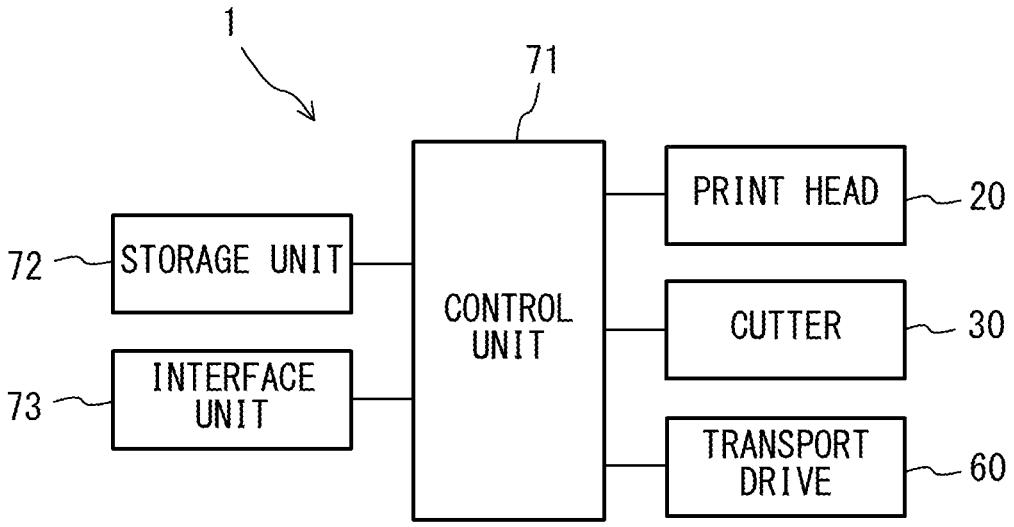
FIG. 3 illustrates the control configuration of a printing apparatus in accordance with an embodiment.

FIG. 3 illustrates the control configuration of the printing apparatus 1.

As depicted in FIG. 1, the printing apparatus 1 includes a platen roller 10, a print head 20, a cutter 30, a pair of ejection rollers 41 and 42, i.e., an example of an ejector, and a roll shaft 50. As depicted in FIG. 3, the printing apparatus 1 further includes a transport drive (drive) 60, a control unit 71, a storage unit 72, and an interface unit 73.

Figure 6:
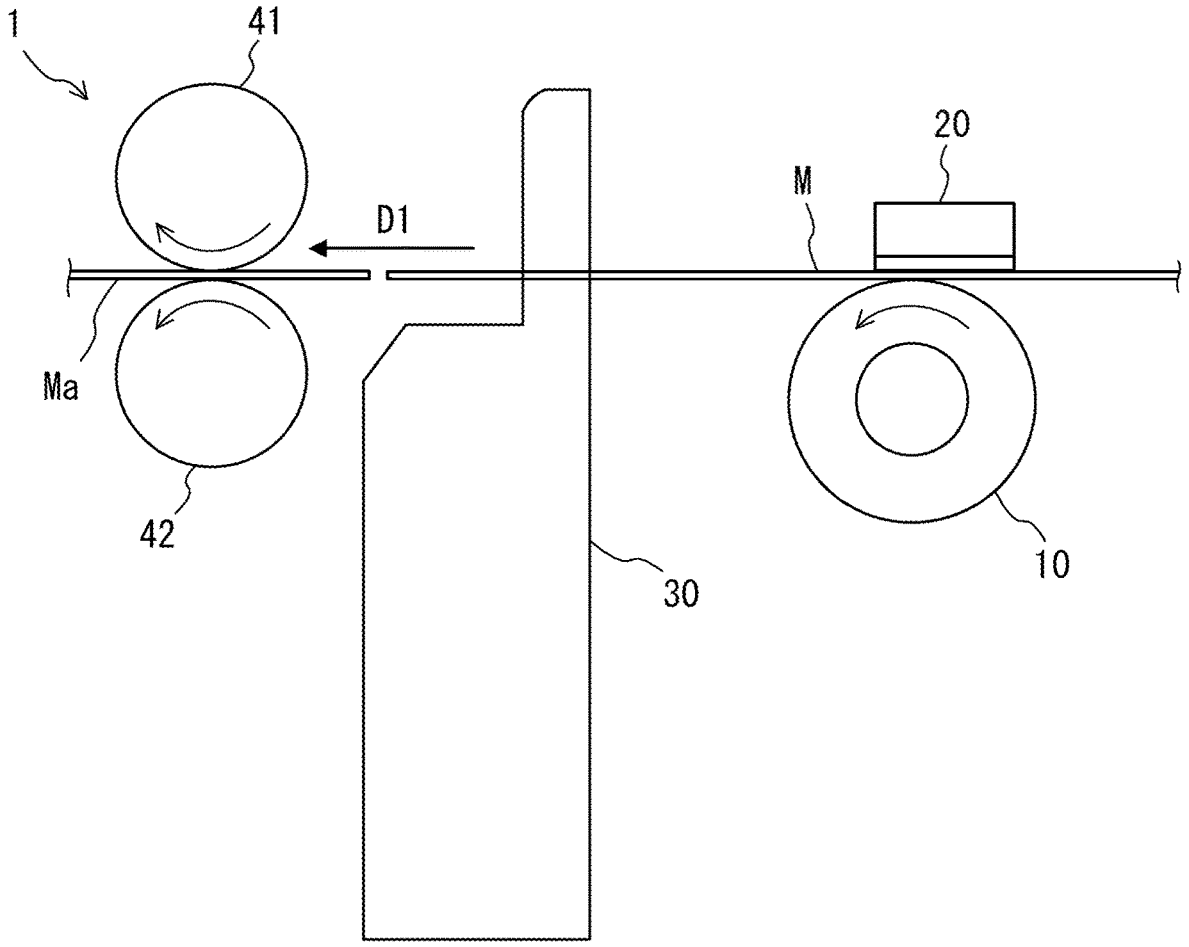
FIG. 6 is a side view for illustrating transport control performed by a printing apparatus in accordance with an embodiment (example 1)
Figure 7:
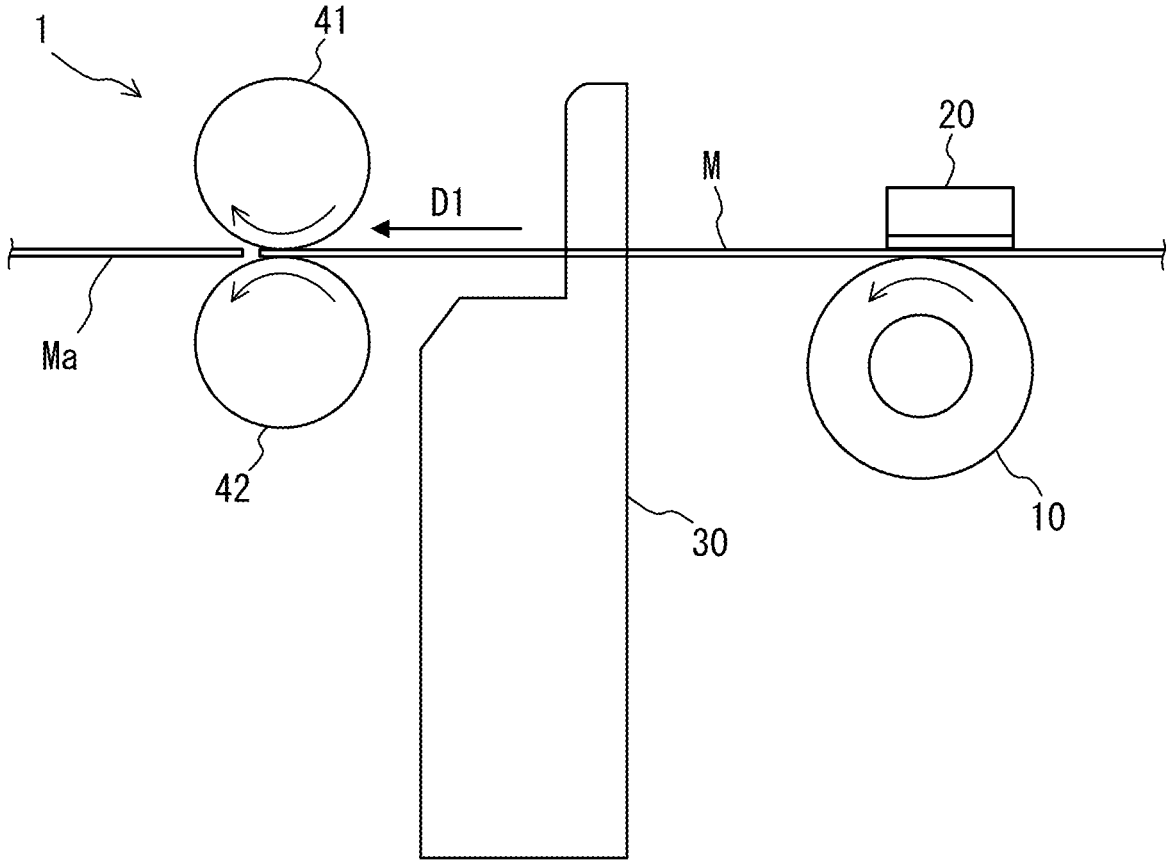
FIG. 7 is a side view for illustrating transport control performed by a printing apparatus in accordance with an embodiment (example 2)
Figure 8:
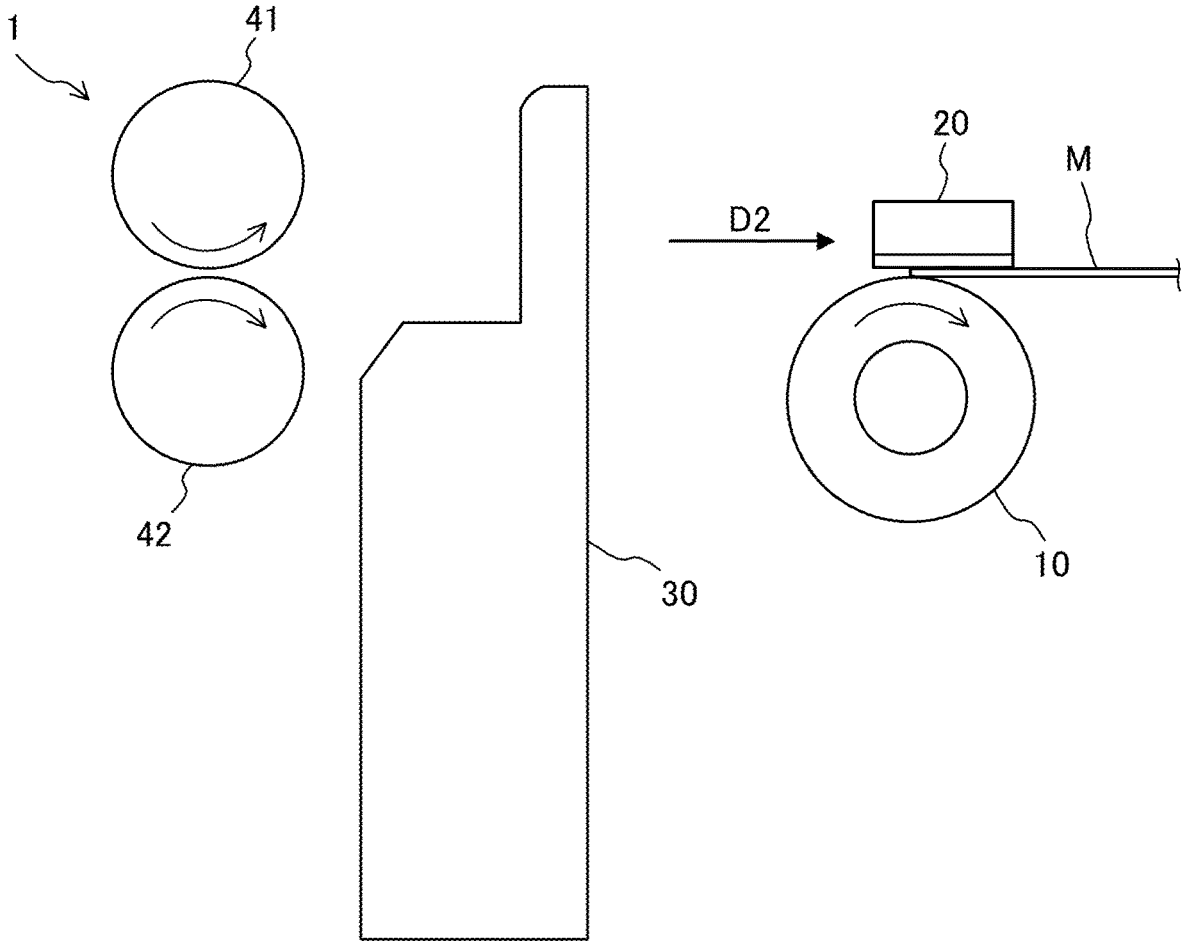
FIG. 8 is a side view for illustrating transport control performed by a printing apparatus in accordance with an embodiment (example 3)

The platen roller 10 rotates by being driven by the transport drive 60 (described hereinafter) so as to transport a long medium M. The medium M is rolled up and may be, for example, rotatably supported by the roll shaft 50 (described hereinafter) at an axial core. As depicted in FIGS. 6 and 7 (described hereinafter), the rolled-up medium M is unspooled in a rotation direction D1 by rotation of the platen roller 10 so as to be transported. As depicted in FIG. 8, when the platen roller 10 is reversely rotated, the medium M is transported in a reverse direction D2 opposite to the ejection direction D1. For example, the platen roller 10 may be a rubber roller. An example of the medium M may be one for forming labels that each include an adhesive layer on one surface (front surface) or inside thereof and are used as luggage tags by an airline printer.

The print head 20 is disposed to face the platen roller 10. The print head 20 prints on a medium M sandwiched by the platen roller 10 and the print head 20. The printing scheme of the print head 20 is not particularly limited and may be, for example, a thermal sensing scheme. When the printing scheme of the print head 20 is a thermal sensing scheme, the medium M is, for example, a thermosensitive label.

As depicted in FIG. 2, the cutter 30 cuts off a printed portion Ma of the medium M on which the print head 20 has performed printing.

The pair of ejection rollers 41 and 42 are disposed to face each other and transport, in a sandwiching manner, the printed portion M cut off by the cutter 30. Among the pair of ejection rollers 41 and 42, the ejection roller 41 is a driving roller that rotates by being driven by the transport drive 60 (described hereinafter), and the ejection roller 42 is a driven roller. The pair of ejection rollers 41 and 42 may constitute an example of a conveyor. Alternatively, an ejection belt may be used as the conveyor.

As described above, the roll shaft 50 depicted in FIG. 1 rotatably supports the rolled-up medium M at the axial core of this medium.

For example, the transport drive 60 depicted in FIG. 3 may be a motor that drives the ejection roller 41 and the platen roller 10. Thus, the pair of ejection rollers 41 and 42 and the platen roller 10 rotate at the same timing. In one possible example, a transport drive for driving the ejection roller 41, i.e., a driving roller, and a transport drive for driving the platen roller 10 may be individually disposed.

The control unit 71 controls the print head 20, a cutter drive provided for the cutter 30, and the transport drive 60. For example, the control unit 71 may include a processor (e.g., central processing unit: CPU) that reads and executes a program stored in the storage unit 72.

For example, the storage unit 72 may be a read only memory (ROM) constituted by a read-only semiconductor memory storing a program to be executed by the processor of the control unit 71, or a random access memory (RAM) constituted by a randomly writable/readable semiconductor memory used as a working storage region on an as-needed basis when the processor executes various programs.

The interface unit 73 communicates various information with external devices. For example, the interface unit 73 may obtain a program to be executed by the processor from a storage medium or via a network, or receive print data from a computer that generates the same.

The following describes transport control performed by the printing apparatus 1 by referring to FIGS. 4 and 6-9.

Figure 4:
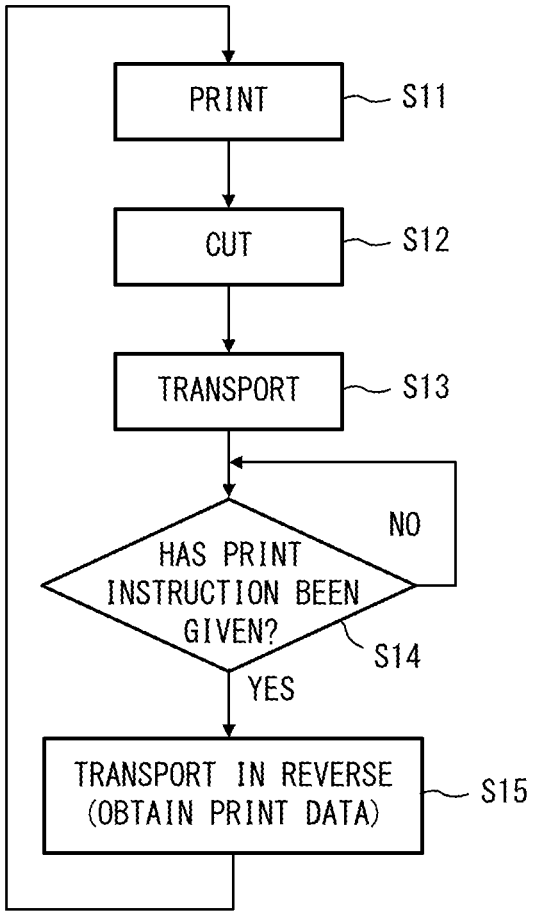
FIG. 4 is a flowchart for illustrating transport control performed by a printing apparatus in accordance with an embodiment.

FIG. 4 is a flowchart for illustrating the transport control performed by the printing apparatus 1.

Figure 5:
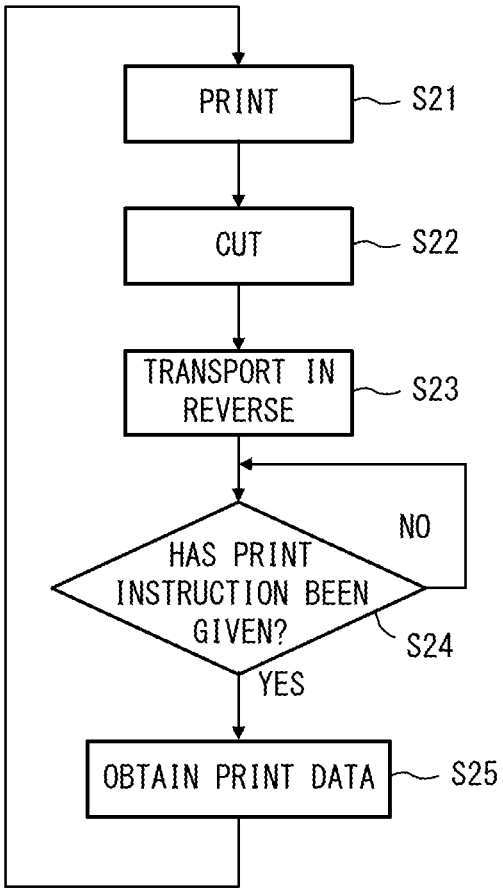
FIG. 5 is a flowchart for illustrating transport control performed by a printing apparatus in a comparative example.

FIG. 5 is a flowchart for illustrating transport control performed by a printing apparatus in a comparative example.

FIGS. 6-8 are side views for illustrating the transport control performed by the printing apparatus 1.

Figure 9:
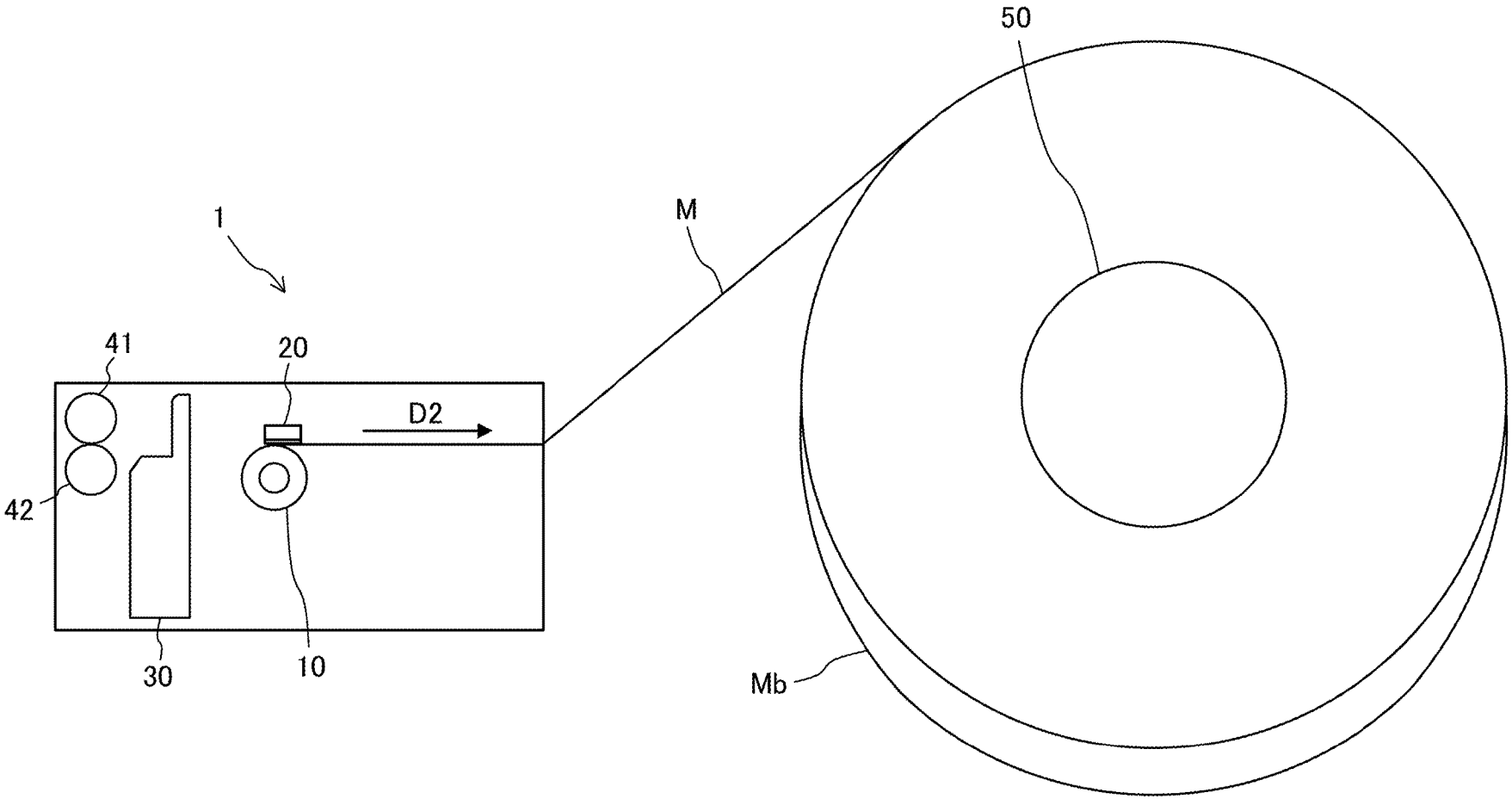
FIG. 9 is a side view illustrating the internal structure of a printing apparatus in accordance with an embodiment, with a medium sagging.

FIG. 9 is a side view illustrating the internal structure of the printing apparatus 1, with a medium M sagging.

As indicated in FIG. 4, first, the control unit 71 depicted in FIG. 3 causes the print head 20 to print on a medium M (step S11).

Next, after the medium M is transported in the ejection direction D1 by the platen roller 10 (transport drive 60) such that the rear end portion of a printed portion Ma in the ejection direction D1 (upstream-side end portion) arrives at the cutter 30 (see FIG. 2), the control unit 71 controls the cutter 30 so as to cut off the printed portion Ma (step S12).

Next, as indicated in FIG. 6, the control unit 71 controls the transport drive 60 such that the platen roller 10 transports the medium M in the ejection direction D1 and holds the same still (step S13).

Alternatively, as indicated in FIG. 7, the control unit 71 may control the transport drive 60 such that the platen roller 10 transports the medium M in the ejection direction D1 to a position where the medium M is sandwiched by the pair of ejection rollers 41 and 42, and hold the medium M still at this position. In this case, when the medium M is transported in a reverse direction D2 in a reverse transport process (described hereinafter) (step S15), the medium M will have a sagging portion (loose portion) Mb, as depicted in FIG. 9. An impact will be given to the medium M in resolving the sagging portion Mb through the transport of the medium M in the ejection direction D1 during printing. The position on the medium M to which the impact is given, i.e., the position at which the sagging portion Mb is resolved, is a position at which the transport in the reverse direction D2 starts. In this regard, when, as described above by referring to FIG. 7, the control unit 71 controls the transport drive 60 such that the platen roller 10 transports the medium M in the ejection direction D1 to a position where the medium M is sandwiched by the pair of ejection rollers 41 and 42, and holds the medium M still at this position, the position at which the medium M is held still is the position at which the transport in the reverse direction D2 starts. At the position at which the transport in the reverse direction D2 starts, the impact will be attenuated because the medium M is held by being sandwiched by the pair of ejection rollers 41 and 42. Note that the longer the outer diameter of the roll of the medium M is, the larger impact the medium M will receive.

Next, on the basis of an operation performed on the printing apparatus 1 by the user or information received from a computer that generates print data, the control unit 71 repeatedly determines whether an instruction to start next printing by the print head 20 has been given (step S14), until such a start instruction is given.

After an instruction to start the next printing is received (step S14: YES), the control unit 71 controls the transport drive 60 such that the platen roller 10 transports the medium M in the reverse direction D2 opposite to the ejection direction D1 (step S15) until, as depicted in FIG. 8, the leading end portion of the medium M arrives at a position between the platen roller 10 and the print head 20. The control unit 71 obtains print data when the medium M is transported in the reverse direction D2. Then, the control unit 71 repeats the processes starting from step S11.

In the comparative example depicted in FIG. 5, as in steps S11 and S12, the control unit 71 causes the print head 20 to perform printing (step S21) and causes the cutter 30 to cut off a printed portion Ma (step S22).

Subsequently, the control unit 71, without causing, unlike in the process of step S13, the platen roller 10 to transport the medium M in the ejection direction D1, causes the platen roller 10 to transport the medium M in the reverse direction D2 such that, as depicted in FIG. 8, the leading end portion of the medium M (downstream-side end portion in the ejection direction D1) arrives at the position between the platen roller 10 and the print head 20 (step S23).

Next, the control unit 71 repeatedly determines whether an instruction to start next printing by the print head 20 has been given (step S24), until such a start instruction is given.

After an instruction to start the next printing is received (step S24: YES), the control unit 71 obtains print data (step S25) and repeats the processes starting from step S21.

Especially in the comparative example, when the leading end portion of a long medium M, such as one for forming luggage tags, which includes an adhesive layer on a surface or inside thereof is held on the platen roller 10 for a long time, the leading end portion will be pasted on the platen roller 10, and after the printing operation in step S21 starts, the medium will be entangled with the platen roller 10.

In the embodiment described above, the printing apparatus 1 includes the platen roller 10, the print head 20, the cutter 30, the transport drive 60, i.e., an example of a drive, and the control unit 71, i.e., an example of a processor. The platen roller 10 transports a long medium M. The print head 20 is disposed to face the platen roller 10 and prints on the medium M. The cutter 30 cuts off a printed portion Ma of the medium M on which the print head 20 has performed printing. The transport drive 60 drives the platen roller 10. The control unit 71 controls the transport drive 60. After the printed portion Ma is cut off by the cutter 30 (step S12 in FIG. 4), the control unit 71 controls the transport drive 60 such that the platen roller 10 transports the medium M in the ejection direction D1 and holds the same still (step S13). After an instruction to start the next printing by the print head 20 is received (step S14: YES), the control unit 71 controls the transport drive 60 such that the platen roller 10 transports the medium M in the reverse direction D2 opposite to the ejection direction D1 (step S15).

In the comparative example depicted in FIG. 5, after the printed portion Ma is cut off (step S22), the platen roller 10 transports the medium M in the reverse direction D2 (step S23), in particular, the platen roller 10 transports the medium M in the reverse direction D2 such that the leading end portion arrives at the position between the platen roller 10 and the print head 20. Thus, the leading end portion of the medium M is held on the platen roller 10 for a long time and thus pasted on the platen roller 10, and after the printing operation (step S21) starts, the medium M could be entangled with the platen roller 10.

In the present embodiment, by contrast, as described above, after the printed portion Ma is cut off by the cutter 30, the control unit 71 causes the platen roller 10 to transport the medium M in the ejection direction D1 and hold the same still. Thus, the leading end portion of the medium M is not held on the platen roller 10 for a long time, so that the medium M can be prevented from being entangled with the platen roller 10 after the printing operation (step S11) starts, because the leading end portion of the medium M is not pasted on the platen roller 10.

In the present embodiment, in addition, after the printed portion Ma is cut off by the cutter 30, since the platen roller 10 transports the medium M in the ejection direction D1 and holds the same still, the printed portion Ma that has been cut off can be sent out for ejection by the ejection rollers 41 and 42, which are driven by the same drive source as the platen roller 10 (or the printed portion Ma can be sent out for ejection by the remaining portion of the medium M).

In the present embodiment, accordingly, the medium M can be prevented from being entangled with the platen roller 10, and the printed portion Ma (medium M) can be ejected. Furthermore, after an instruction to start the next printing by the print head 20 is received, the control unit 71 causes the platen roller 10 to transport the medium M in the reverse direction D2 opposite to the ejection direction D1, so that a reduction in the printing performance can be suppressed by performing the transporting in the reverse direction D2 and the receiving of print data in parallel.

In the present embodiment, the printing apparatus 1 further includes the pair of ejection rollers 41 and 42, i.e., an example of a conveyor that transports, in a sandwiching manner, a printed portion M cut off by the cutter 30. After the printed portion Ma is cut off by the cutter 30 (step S12 in FIG. 4), as indicated in FIG. 7, the control unit 71 controls the transport drive 60 such that the platen roller 10 transports the medium M in the ejection direction D1 to a position where the medium M is sandwiched by the pair of ejection rollers 41 and 42, and holds the medium M still at this position.

Accordingly, printing will start after the medium M is transported in the reverse direction D2 opposite to the ejection direction D1 by the platen roller 10 from the position where the medium M is sandwiched by the pair of ejection rollers 41 and 42. Thus, when the medium M is transported in the ejection direction D1 during printing, the sagging portion Mb of the medium M that has been made upon the start of the printing due to the transport in the reverse direction D2 is resolved at a position at which the transport of the medium M in the reverse direction D2 started. At the position at which the transport in the reverse direction D2 started, the medium M is held between the pair of ejection rollers 41 and 42 and between the platen roller 10 and the print head 20, i.e., held at two sites. Hence, the medium M, while in a held state like this, can receive an impact resulting from the sagging portion Mb being resolved. Accordingly, slipping that could occur in association with the medium M receiving an impact can be suppressed, thereby allowing for suppression of an occurrence of a printing failure, e.g., printing shrinkage, on a long medium M that has been rolled up.

The present invention is not simply limited to the embodiments described herein. Components of the embodiments may be embodied in a varied manner. For example, a plurality of components disclosed with reference to the described embodiments may be combined, as appropriate, to achieve various inventions. Accordingly, various variations and applications of the invention can be provided without departing from the gist of the invention.

The invention claimed is:

1. A printing apparatus comprising:

a platen roller that transports a rolled up medium;

a print head that is disposed to face the platen roller and prints on the medium;

a cutter that cuts off, from the medium, a printed portion on which printing has been performed by the print head;

a drive that drives the platen roller;

a processor that controls the drive, and a conveyor that transports, in a sandwiching manner, the printed portion cut off by the cutter, wherein after the printed portion is cut off by the cutter, the processor controls the drive such that the platen roller transports the medium in an ejection direction to a position where the medium is sandwiched by the conveyor, and holds the medium still, after an instruction to start next printing by the print head is received, the processor controls the drive such that the platen roller transports the medium in a reverse direction opposite to the ejection direction, the processor performs receiving of print data in parallel with transporting of the medium in the reverse direction, and when the medium is transported in the ejection direction during printing, a sagging portion of the medium that has been made upon the start of the printing due to the transporting in the reverse direction is resolved at a position at which the transporting of the medium in the reverse direction started.

* * * * *